US006470643B1

(12) United States Patent
Cantley

(10) Patent No.: US 6,470,643 B1
(45) **Date of Patent: *Oct. 29, 2002**

(54) PLASTIC LATTICE

(75) Inventor: Richard W. Cantley, Troy, MI (US)

(73) Assignee: Richard Wilson Cantley, Troy, MI (US)

( * ) Notice: Subject to any disclaimer, the term of this patent is extended or adjusted under 35 U.S.C. 154(b) by 56 days.

This patent is subject to a terminal disclaimer.

(21) Appl. No.: 09/883,711

(22) Filed: Jun. 18, 2001

Related U.S. Application Data

(63) Continuation-in-part of application No. 09/740,622, filed on Dec. 19, 2000, now Pat. No. 6,286,284, which is a continuation of application No. 09/338,110, filed on Jun. 23, 1999.

(60) Provisional application No. 60/116,046, filed on Jan. 14, 1999.

(51) Int. Cl.[7] ..... B44F 7/00

(52) U.S. Cl. ..... 52/660; 52/663; 52/664; 52/669; 52/311.1; 52/313; 52/311.2

(58) Field of Search ..... 52/660, 662–669, 52/311.1–311.3, 313, 315; D25/100, 152

(56) References Cited

U.S. PATENT DOCUMENTS

| | | | |
|---|---|---|---|
| 2,672,658 | A | 10/1954 | Pederson |
| 2,752,276 | A | 6/1956 | Woock |
| 3,716,164 | A | 2/1973 | Fennema |
| 4,268,049 | A | 5/1981 | Salvador |
| 4,333,287 | A | 6/1982 | Lewis |
| D296,935 | S | 7/1988 | Erceg |
| 4,907,389 | A | 3/1990 | Pettit |
| 5,080,150 | A | 1/1992 | Deadwyler, Jr. |
| 5,191,985 | A | 3/1993 | Licari |
| D357,073 | S | 4/1995 | Reum |
| D366,532 | S | 1/1996 | Herbst et al. |
| D374,485 | S | 10/1996 | Brown |
| 5,657,605 | A | 8/1997 | Sidney |
| 5,795,267 | A | 8/1998 | Weaver |
| D402,381 | S | 12/1998 | Gruda et al. |
| D423,687 | S | 4/2000 | Cantley |
| D442,701 | S | 5/2001 | Cantley |
| 6,286,284 | B2 | 9/2001 | Cantley |

*Primary Examiner*—Carl D. Friedman
*Assistant Examiner*—Jennifer I. Thissell
(74) *Attorney, Agent, or Firm*—Gifford, Krass, Groh, Sprinkle, Anderson & Citkowski, P.C.

(57) ABSTRACT

A molded plastic lattice simulates a lattice of separate superposed members. A first set of elongated members lies in one plane, with each of the members having a concave upper surface, a concave lower surface, and a pair of edges interconnecting the upper and lower surfaces. The upper and lower surfaces each have central regions that are intermediate the edges. The central regions of the upper and lower surfaces are separated by a distance less than the thickness of the edges such that each of the members have a bowtie shaped cross-section. A second set of elongated members lies in a second plane, with the second set of members intersecting and interconnecting the first set at junction regions. Each of the members in the second set also has a concave upper surface, a concave lower surface, and a pair of edges interconnecting upper and lower surfaces. The upper and lower surfaces each have central regions intermediate the edges, with the central regions being separated by a distance less than the thickness of the edges such that each of the members has a bowtie shaped cross-section. Preferably, the central region of the lower surface of each of the members in the first set is generally co-planer with the central region of the upper regions of each of the members in the second set.

16 Claims, 6 Drawing Sheets

FIG - 1
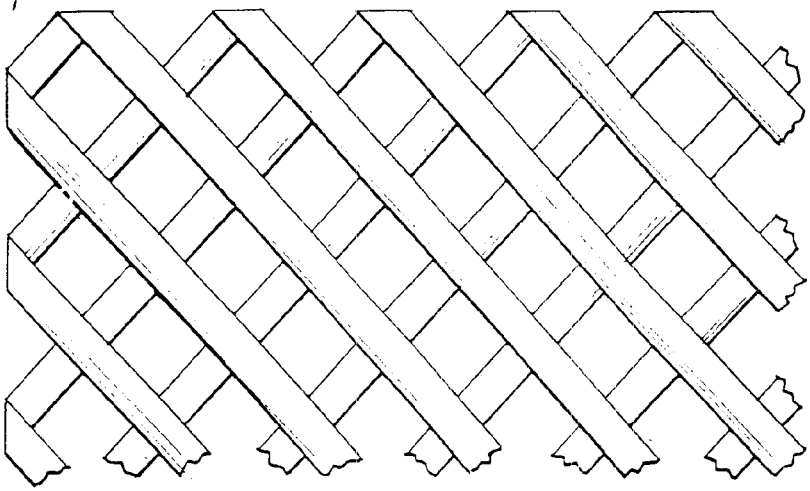
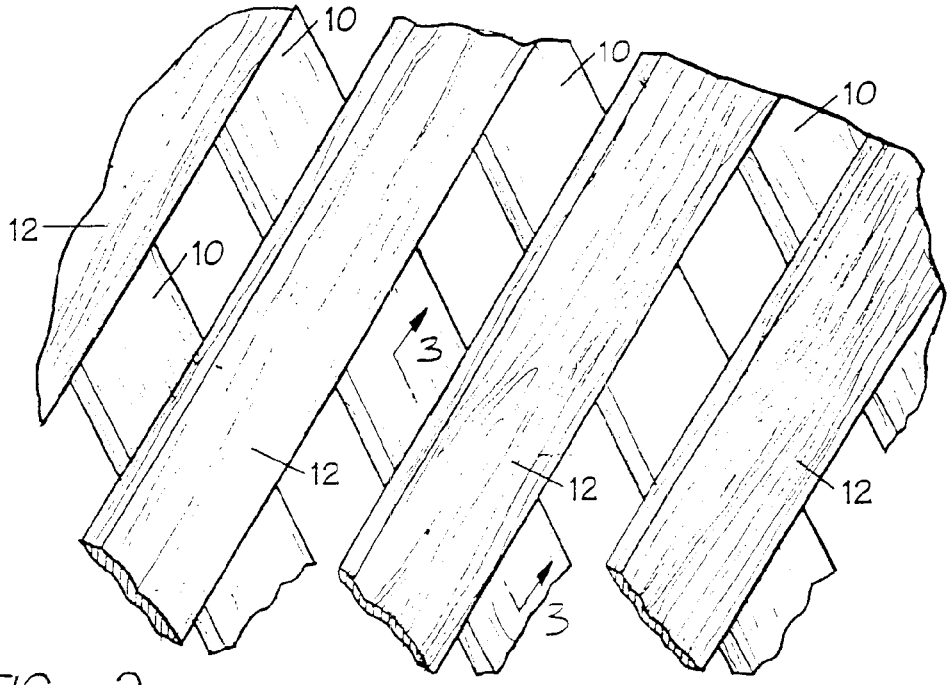
FIG - 2
PRIOR ART
FIG - 3
PRIOR ART
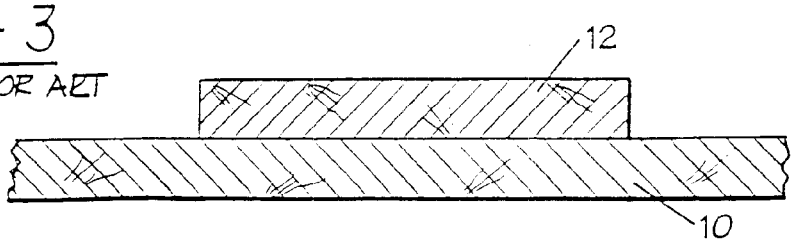

FIG-14
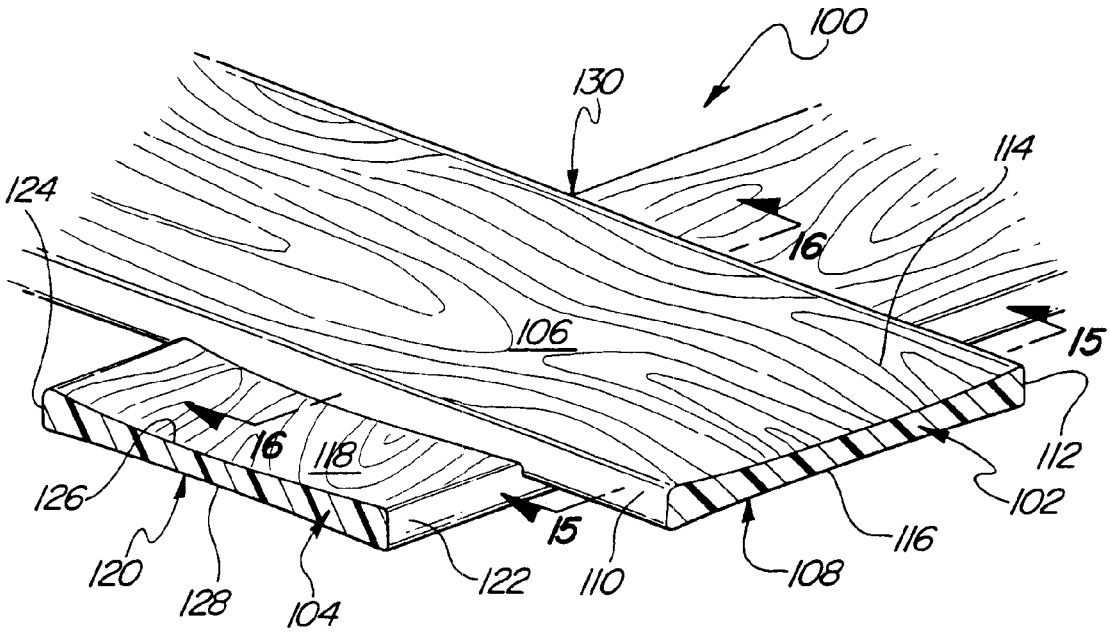
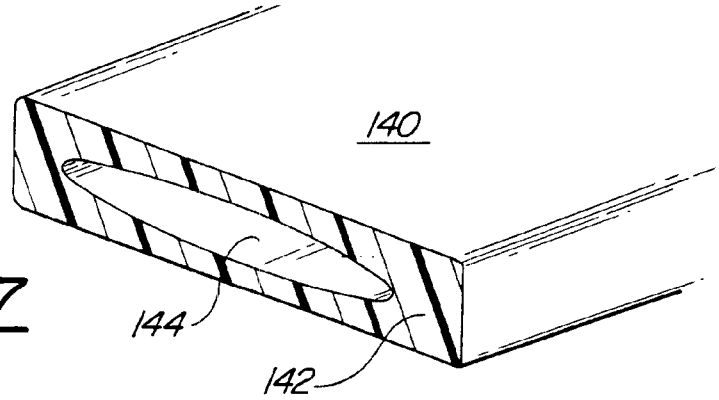
FIG-17
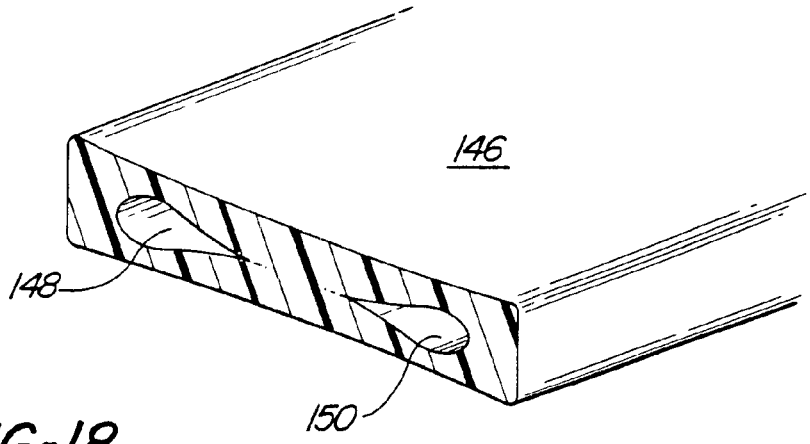
FIG-18

PLASTIC LATTICE

REFERENCE TO RELATED APPLICATIONS

This application is a continuation in part of U.S. patent application Ser. No. 09/740,622, filed Dec. 19, 2000, U.S. Pat. No. 6,286,284, Jul. 11, 2001 which is a continuation of U.S. patent application Ser. No. 09/338,110, filed Jun. 23, 1999, which claims the benefit of U.S. provisional application Ser. No. 60/116,046, filed Jan. 14, 1999.

FIELD OF THE INVENTION

The present invention relates generally to molded plastic lattice and, more specifically, to a plastic lattice wherein the members forming the lattice have bow-tie shaped cross sections.

BACKGROUND OF THE INVENTION

Traditional wood lattice, such as shown in FIGS. 2 and 3, has been long known and used for both decorative and functional purposes, as part of fences, porches, trellises, and other places. Traditional wood lattice consists of a first plurality of individual mutually parallel wooden slats 10 lying in a common plane and a second plurality of individual, mutually parallel wooden slats 12 lying in a second plane. The second plurality of slats 12 runs at an angle to the first plurality of slats 10 and is superposed on the first set of slats 10 to create a mesh-like appearance.

Traditional wood lattice has several drawbacks. First, because the lattice is typically used outdoors and the wood slats are exposed to the elements, the lattice requires periodic maintenance or its appearance will become unacceptable. Secondly, traditional wood lattice is expensive due to the cost of the wood slats and the cost of assembling the slats into a lattice.

There have been numerous attempts to overcome the shortcomings of traditional wood lattice. For example, U.S. Pat. No. 2,672,658 to Pederson shows a wood lattice wherein specific combinations of tongues and grooves are formed such that the first and second sets of slats lie generally in the same plane. This creates a generally two-dimensional wooden lattice with a thickness less than would be created if the first and second sets of slats were superposed upon another. However, the Pederson invention is expensive and time consuming to create and does not address the maintenance problems associated with wooden lattice. Also, many users prefer that lattice have a three-dimensional appearance. The Pederson invention attempts to create a three-dimensional appearance by the positioning of the wood grain of the various portions of the lattice. However, this is only partially successful as the wood grain will not always be apparent, especially if the lattice is painted.

Another alternative to traditional wood lattice is plastic lattice. Early plastic lattice was created by duplicating the construction of wood lattice. That is, sets of plastic slats, similar in dimension to wood slats, were molded and attached to one another with one set superposed on another set in the same way that wood lattice is formed. This design overcomes the maintenance limitations of traditional wood lattice the cost of molding individual slats and assembling them into sheets of lattice is needlessly expensive. This approach fails to take the advantage of one of the major advantages of plastic. That is, plastic molding often allows multiple piece assemblies to be molded as a single body.

Another approach to plastic lattice was two-dimensional plastic lattice. In this design, the first and second sets of slats laid in the same plane. This design allowed the plastic lattice to be molded as a one-piece body thereby giving significant cost advantages over the multi-piece plastic lattice. However, the two-dimensional plastic lattice failed to give the desired three-dimensional appearance of traditional wood lattice and multiple piece plastic lattice.

It is most efficient and cost effective if plastic injection molded parts have a generally uniform thickness throughout so that liquid plastic can flow from one part of the mold to another so that various parts of the injection molded piece cool at similar rates. Therefore, it would be difficult to injection mold a one-piece plastic lattice that exactly duplicated traditional wood lattice, because the areas where the first and second sets of slats overlap would be twice as thick as the portions where they did not overlap. This would lead to uneven cooling and difficulties with the flow of the liquid plastic.

U.S. Design Pat. No. D402,381 to Gruda shows a molded plastic lattice that attempts to create a three-dimensional appearance similar to traditional wood lattice. This plastic lattice is shown in FIGS. 4 and 5. The plastic lattice disclosed in the Gruda patent attempts to give a three-dimensional appearance without having areas that are twice as thick as others. To accomplish this, the first and second sets of plastic slats intersect and overlap so that a majority of both the first and second sets of slats are in the same plane. However, one set of slats is offset from the second set of slats so that it sits above the other set of slats. This creates a three-dimensional appearance even though the first and second sets of slats are not offset as much as traditional wooden slats. However, the overlapping junction areas are only somewhat thicker than the rest of the slats. One drawback to this design is that the thicker junction areas use additional plastic and cool slower when compared to two-dimensional plastic lattice, as discussed previously. Another drawback is that the offsets may hinder the flow of liquid plastic in the mold.

SUMMARY OF THE INVENTION

The present invention overcomes the limitations of the prior designs discussed above. In one preferred embodiment of the present invention, a one-piece plastic molded body simulates a lattice of superposed members. The body includes a first plurality of elongated members that lies in a first plane, with each of the members having a concave upper surface, a concave lower surface, and a pair of edges interconnecting the upper and lower surfaces. The upper and lower surfaces each have central regions intermediate the edges, with the central regions of the upper and lower regions being separated by a distance less than the thickness of the edges, such that each of the members has a bow-tie shaped cross-section. A second plurality of elongated members lies in a second plane and intersects and interconnects the first plurality of members at a plurality of junction regions. Each of the members of the second plurality has a concave upper surface, a concave lower surface, and a pair of edges that connect the upper and lower surfaces. The upper and lower surfaces each have central regions intermediate the edges, with the central regions being separated by less than the thickness of the edges, such that each of the members has a bow-tie shaped cross-section. In some embodiments, the central region of the lower surface of each of the members of the first plurality is generally co-planer with the central region of the upper surfaces of each of the members of the second plurality.

BRIEF DESCRIPTION OF THE DRAWINGS

FIG. 1 is an elevational view of a lattice which may be constructed in a number of ways;

FIG. 2 is a perspective view of a portion of traditional wood lattice;

FIG. 3 is a cross-sectional view of the wood lattice of FIG. 2 taken along lines 3—3 of FIG. 2;

FIG. 14 is a perspective view of another alternative embodiment of a plastic lattice according to the present invention;

FIG. 17 is a cross-sectional view of a single member of a plastic lattice illustrating a void created when the lattice member is formed using a gas-assist injection molding technique; and FIG. 18 is a cross-sectional view of a single member of a plastic lattice according to the present invention having a bow-tie shaped cross section, illustrating voids that are created when the member is formed using a gas-assist injection molding technique.

DETAILED DESCRIPTION OF THE PREFERRED EMBODIMENT

Figure 6:
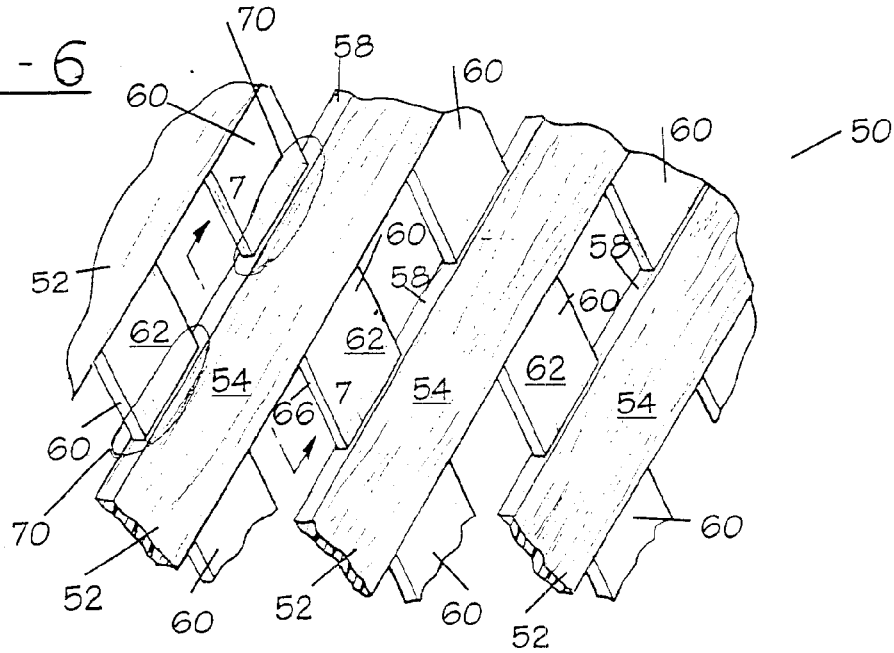
FIG. 6 is a perspective view of a portion of a plastic lattice according to the present invention.
Figure 7:
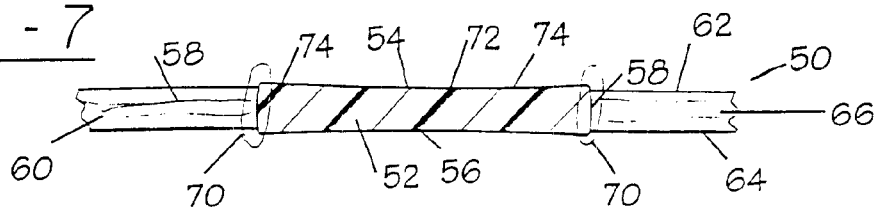
FIG. 7 is a cross-sectional view of the plastic lattice of FIG. 6 taken along lines 7—7 of FIG. 6.

Referring now to FIGS. 6 and 7, a preferred embodiment of a molded plastic lattice is generally shown at 50. The plastic lattice 50 is designed to be generally two-dimensional, as shown in FIG. 7, while giving a three-dimensional appearance, as shown in FIG. 6.

Figure 4:
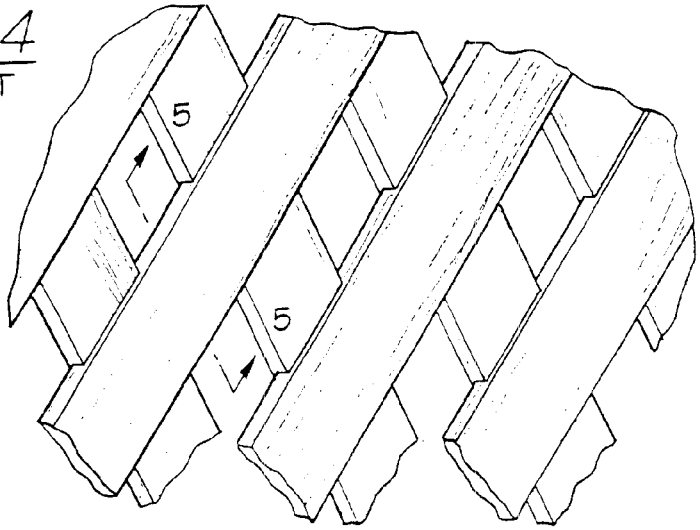
FIG - 4 PRIOR ART
FIG. 4 is a perspective view of a portion of one type of prior art plastic lattice.
Figure 5:
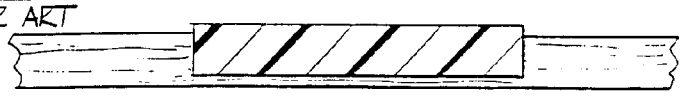
FIG - 5 PRIOR ART
FIG. 5 is a cross-sectional view of the plastic lattice of FIG. 4 taken along lines 5—5 of FIG. 4.

The lattice 50 is a one piece molded plastic body that simulates separate superposed members such as shown in FIGS. 2 and 3. The body includes a first plurality of continuous elongated members 52 which all lie in a common plane. These members 52 simulate a first set of wooden slats. Each member has an upper surface 54, a lower surface 56, and a pair of edges 58 interconnecting the upper 54 and lower 56 surfaces. By "continuous," it is meant that the members 52 appear to be uninterrupted as if each were an elongated wooden slat. The members 52 are parallel to one another and spaced apart by a short distance. The lattice 50 also includes a second plurality of discontinuous elongated members 60 which intersect and interconnect the continuous members 52. By "discontinuous," it is meant that each member 60 appears as if made up of many small sections with each individual section interconnecting a pair of continuous members 52. These individual sections are aligned with one another so as to form a discontinuous member 60. Because the members 60 appear to be discontinuous, they appear to reside below the continuous members 52. The discontinuous members 60 all lie in a common plane and are parallel to one another and spaced apart by a short distance. Preferably, the continuous members 52 and discontinuous members 60 all lie in the same common plane as shown in FIG. 7. This is what is meant when the present invention is referred to as being generally two-dimensional. The continuous members 52 and discontinuous members 60 both lie in the same plane and are not offset three-dimensionally from one another, as was the case with the prior art design shown in FIGS. 4 and 5. The combination of the continuous members 52 and discontinuous members 60 appears to form a lattice of separate superposed members. The discontinuous members 60 each have an upper surface 62, a lower surface 64, and a pair of edges 66 interconnecting the upper and lower surfaces. While it is preferred that the members all lie in a common plane, they could be in separate planes that are offset from one another.

As shown, the continuous members 52 and the discontinuous members 60 intersect at approximately a 90 degree angle. This is a common configuration for lattice. However, the members 52 and 60 may meet at other angles to give a different look. The spaces between the parallel continuous members 52 and the spaces between parallel discontinuous members 60 may be varied to change the look of the lattice. Generally, the spacing between continuous members 52 and the spacing between discontinuous members is similar, though this also could be varied. The width of the members 52 and 60 may also be varied. For example, in some embodiments of the present invention, the members 52 and 60 have a width between 1 and 2 inches and the spacing between members is between 2 and 3 inches. In one particular embodiment, the width of the members is approximately 1.5 inches and the spacing between members is approximately 2.75 inches.

The lattice 50 is preferably injection molded and therefore the continuous members 52 and discontinuous members 60 form a unitary body. That is, the continuous members 52 and discontinuous members 60 are formed as one piece and therefore the members 52 and 60 cannot be truly separated. Instead, the description of the members 52 and 60 as continuous and discontinuous is for ease of description.

Also for ease of description, the areas where the discontinuous members 60 intersect the continuous members 52 are defined herein as junction regions 70. According to the present invention, the three-dimensional appearance of the generally two-dimensional lattice 50 is achieved by having a discontinuity at each of the junction regions 70. That is, there is a slight step between the upper surface 62 of the discontinuous member 60 and the corresponding upper surface 54 of the continuous member 52 at the junction region 70. This slight step or discontinuity creates the illusion that the lattice 50 is three-dimensional. The discontinuity may be achieved in a number of ways. In a preferred embodiment, as shown in FIG. 7, the upper and lower surfaces 54, 56 of the continuous members 52 are slightly concave. The concavity of the surfaces 54, 56 serves two functions. First, the concavity serves to visually distinguish the upper surface 54 of the continuous members 52 from the upper surfaces 62 of the discontinuous members 60, which are preferably not concave. Secondly, the concavity of the surfaces 54, 56 creates slightly raised edges thereby creating a discontinuity at the junction region 70. A most preferred embodiment of a concave upper surface 54 will be described with reference to FIG. 7. In this Figure, the upper surface 54 is shown as having a central region 72 and a pair of side regions 74. In the most preferred embodiment, the thickness of the continuous member 52 in the central region 72 is approximately the same as the thickness of the non-continuous members 60. This helps with the flow of plastic in the mold and provides more uniform cooling. The upper surface 54 slopes slightly upward towards the side regions 74. This causes the continuous member 52 to be slightly thicker at the side region 74 than at the central region 72. In one embodiment, a three degree rise is formed in the upper surface 54 between the central region 72 and each of the side regions 74. That is, the upper surface 54 slopes upwardly from the central region 72 to each of the side regions 74 at approximately three degrees. This causes the side regions 74, in one embodiment, to be approximately 0.030 inch thicker than the central region 72. This also creates a discontinuity of approximately 0.015 inch between each side region and the upper surface 62 of the adjacent discontinuous member 60. The slight concavity of the upper surface 54, the slightly increased thickness at the side regions 74, and the small discontinuities at the junction region 70 create an effective illusion of the lattice 50 being three-dimensional. As shown in FIG. 7, the lower surface 56 is also concave. Preferably, the lower surface 56 is a mirror image of the upper surface 54. However, in some applications the lattice 50 will be viewed from only a single side. In this case, the concavity and discontinuities may be provided on only one side of the lattice 50. The back side may be left entirely flat without discontinuities or concavity.

The concavity of the upper and/or lower surfaces of the continuous members 52 also gives a strength advantage. Because the side regions 74 are thicker than the central regions 72 of the continuous members 52, the continuous members 52 have a "bow-tie" cross-section, as best shown in FIG. 7. This bow-tie cross-section acts like an I-Beam and increases the stiffness of the continuous members 52 and, therefore, the plastic lattice 50.

As shown in FIG. 6, the lattice 50 preferably includes a wood grain pattern on the upper surfaces 54 and 62 of the members 52 and 60 respectively. Preferably, this pattern runs longitudinally on each member to enhance the three-dimensional visual appearance. The wood grain pattern is also preferably included on the lower surfaces 56 and 64 of the members 52 and 60.

Figure 8:
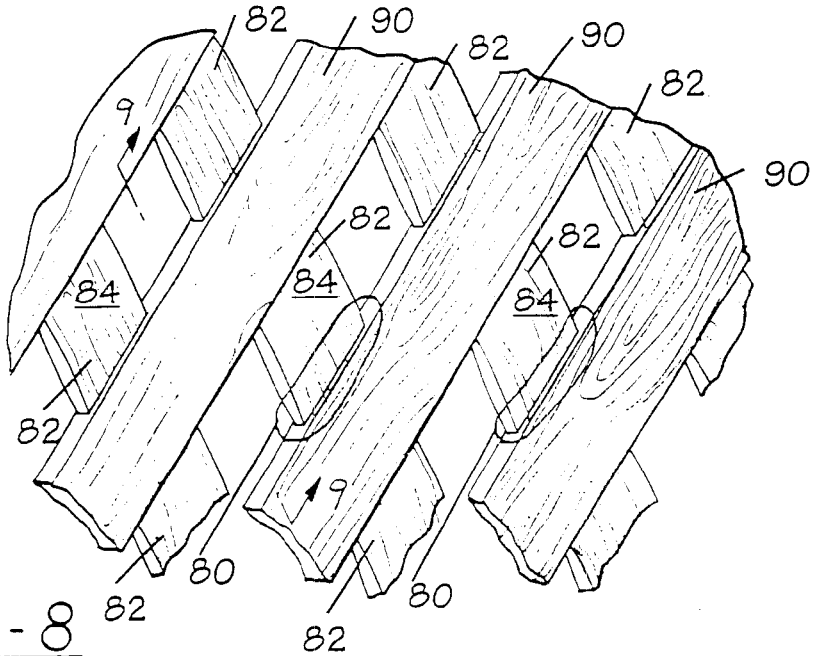
FIG. 8 is a perspective view of a portion of an alternative embodiment of a plastic lattice according to the present invention.
Figure 9:
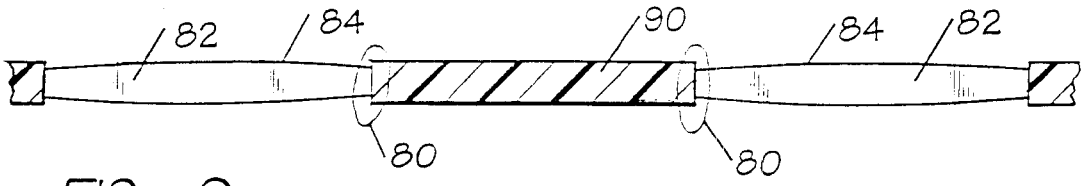
FIG. 9 is a cross-sectional view of the plastic lattice of FIG. 8 taken along lines 9—9 of FIG. 8.
Figure 10:
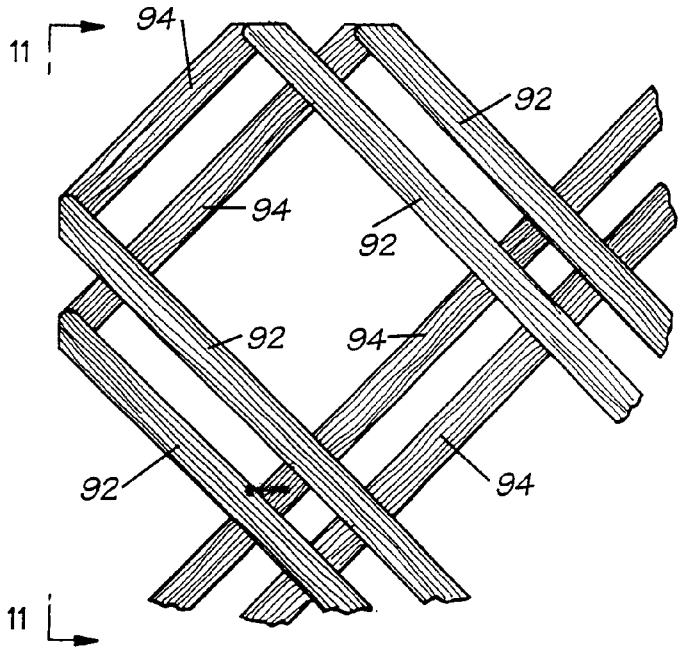
FIG. 10 is a front elevational view of yet another alternative embodiment of a plastic lattice according to the present invention.
Figure 11:
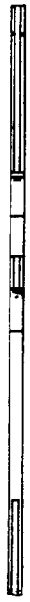
FIG. 11 is a side elevational view of the plastic lattice of FIG. 10, taken along lines 11–11.

In an alternative embodiment, as shown in FIGS. 8 and 9, the discontinuities may be formed at junction regions 80 by making the discontinuous members 82 slightly thinner at each of the junction regions 80. That is, the upper surfaces 84 of the discontinuous members 82 may be made longitudinally convex such that they dip down slightly as they intersect the continuous members 90. In this case, the continuous members 90 may be formed without concave upper surfaces, with the discontinuities at the junction region 80 instead resulting from the thinning of the discontinuous members 82. As yet another alternative, the longitudinal convexity of the upper surfaces 84 of the discontinuous members 82 may be combined with transverse concavity of the continuous members 90 to provide the needed discontinuities at the junction regions 80.

Figure 12:
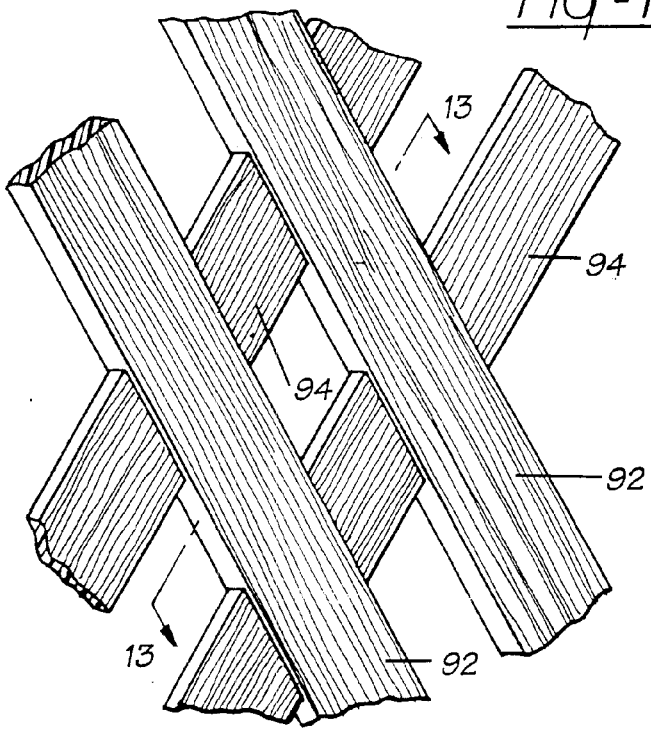
FIG. 12 is a detailed perspective view of a portion of the lattice of FIG. 10.
Figure 13:
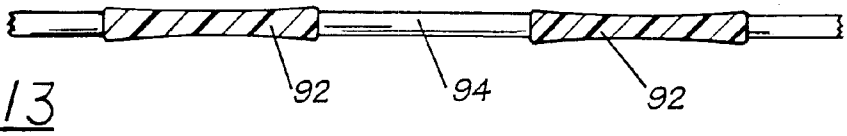
FIG. 13 is a cross-sectional view of the plastic lattice of FIG. 12, taken along lines 13—13.

Yet another alternative embodiment is shown in FIGS. 10–13. This embodiment differs from the first embodiment in that pairs of continuous members 92 are positioned close to one another with a larger space left between adjacent pairs. This gives a different aesthetic appearance. The discontinuous members 94 are likewise formed in closely spaced pairs with each pair spaced from the adjacent pair by a greater distance. Obviously, the spacing may be varied so as to give a variety of different appearances. As shown in FIGS. 12 and 13, discontinuities between the continuous 92 and discontinuous 94 members are formed in the same way as for the first embodiment. Likewise the paired look of FIG. 10 could be achieved through the other previously discussed approaches to forming discontinuities.

Referring now to FIG. 14, an additional embodiment of a plastic lattice according to the present invention is generally shown at 100. As with earlier embodiments, only a portion of the lattice is shown. However, the lattice is preferably formed in large sheets which may be cut to size for installation. FIG. 14 shows only a portion of one lattice member 102 running one direction and a portion of a single lattice member 104 running in another direction. Preferably, the lattice 100 is formed by a first plurality of mutually parallel elongated members lying in a first plane. Elongated member 102 is part of the first plurality. Each of the members in the first plurality preferably have a concave upper surface 106, a concave lower surface 108, and a pair of edges 110 and 112 interconnecting the upper and lower surfaces. The upper and lower surfaces 106 and 108 may be considered to have central regions, 114 and 116 respectively, intermediate the edges 110 and 112. The distance between the central regions of the upper and lower surfaces is less than the thickness of the edges. This gives the cross section of the member 102 a bowtie shape.

A second plurality of mutually parallel elongated members lies in a second plane. Elongated member 104 is part of the second plurality. The members in the second plurality preferably intersect and interconnect the members of the first plurality. The members in the second plurality, such as 104, are formed similarly to the members in the first plurality. Each has a concave upper surface 118, a concave lower surface 120, and a pair of edges 122 and 124 interconnecting the upper and lower surfaces. The upper and lower surfaces 120 also have central regions, 126 and 128 respectively, intermediate the edges 122 and 124. Once again, the central regions 126 and 128 are separated by a distance less than the thickness of the edges 122 and 124. This gives the member 104 a cross section that is bowtie shaped, as shown.

As discussed previously, the bow-tie shape gives several advantages. The thicker edges give an I-beam effect creating a stiffer member while conserving material. Also, the concave surfaces, which may be viewed when the lattice is installed, help with the 3-dimensional appearance of the lattice. The bow-tie shape of the cross section of the members may vary somewhat from the illustration of FIG. 14. In one preferred embodiment, as with an earlier discussed embodiment, the upper surfaces of the members slope upwardly from the central regions to the edges at an angle of approximately 3°. Likewise, the lower surfaces slope downwardly from the central regions to the edges at approximately 3°. It should be understood that terms such as upper and lower are merely for illustration purposes and do not limit the orientation of actual lattice according to the present invention. In a preferred embodiment of the present invention, the central regions of the members have a thickness of approximately 0.13 inches, while the edges have a thickness of approximately 0.16 inches, though other thicknesses may be used.

The preferred embodiment of FIG. 14 differs from some of the earlier embodiments of the present invention in that lattice members in the first plurality, such as 102, and lattice members in the second plurality 104, lie in separate planes, rather than being generally co-planer. Specifically, the lattice members in the second plurality, such as 104, are offset downwardly from the lattice members in the first plurality, such as 102. The member 102 and 104 are interconnected with each other at what is defined as a junction region 130. The junction region 130 is the area in which the members 102 and 104 overlap. The members 102 and 104 are preferably joined to each other in a particular way. Specifically, the portions of the lower surface 108 of the member 102 adjacent the edges 110 and 112 merge into or join the upper surface 118 of the member 104. Likewise, the portions of the upper surface 118 of the member 104 that are adjacent the edges 122 and 125 merge into or adjoin the lower surface 116 of the member 102. Put another way, thicker portions of the members 102 and 104 overlap to form the interconnection. However, the central regions 116 and 126 are generally co-planer with one another.

Figure 15:
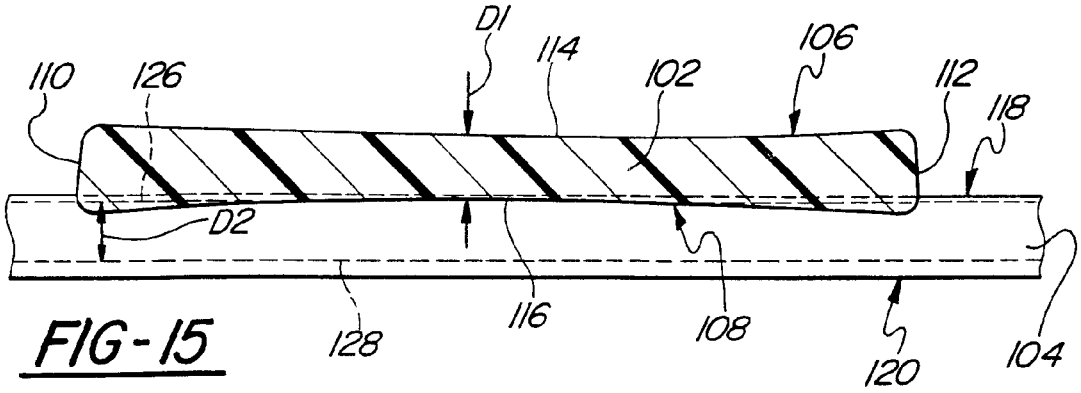
FIG. 15 is a cross-sectional view of the lattice of FIG. 14 taken along lines 15—15.
Figure 16:
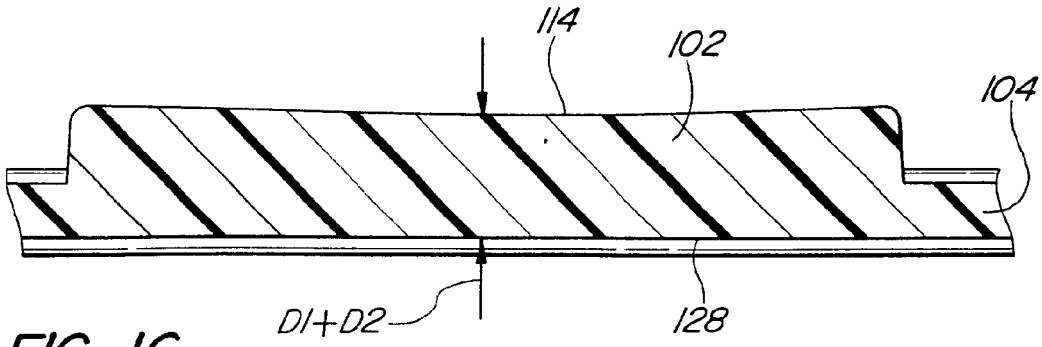
FIG. 16 is a cross-sectional view of the lattice of FIG. 14 taken along the lines 16—16.

FIGS. 15 and 16 may be used to better illustrate the interconnection between the member 102 and the member 104. In FIG. 15, the central region 116 of the lower surface 108 of the member 102 can be seen as corresponding to the thinnest portion of the cross section of the member. The member 104 is shown edge-on. The thinner central region of 126 of the upper surface 118 is shown by a dotted line. Likewise, the thinner central region 128 of the lower surface 120 is also shown by a dotted line. From this figure it can be seen that the central regions 116 and 126 are generally co-planer while the thicker portions merge into the surface of the other member. This design helps give the appearance of a lattice that has a thickness equal to double the thickness of the edges, while the lattice, in fact, has a thickness closer to twice the thickness of the central regions.

As is also shown in FIG. 15, the thinner portion of the member 102, corresponding to the distance between central region 116 and central region 114, may be designated as having a thickness of D1. Likewise, the thickness of the thinnest portion of the member 104, corresponding to the distance between the central region 126 and central region 128, may be designated as having a thickness D2. In the illustrated embodiment of FIG. 15, the distance between the central region 114 of the upper surface 106 of the member 102 and the central region 128 of the lower surface 120 of the member 104 is equal to D1+D2. In alternative embodiments of the present invention, the overlap between the members 102 and 104 may be increased such that the distance between central region 114 and central region 128 is less than D1+D2. This would increase the intermerging of the lower surface 108 of the member 102 and the upper surface 188 of the member 104.

Referring now to FIG. 16, a different cross-sectional view is shown. This view also illustrates the distance between the central region 114 and the central region 128 as D1+D2.

Referring now to FIGS. 17 and 18, a method of molding plastic lattice will be discussed. FIG. 17 shows a lattice member 140 with a generally rectangular cross-section. One approach to molding plastic lattice is to use gas-assist injection molding. In gas-assist injection molding, a portion of liquefied plastic is injected into a mold, followed by gas. The liquid plastic is first injected into the mold and then the gas is injected into the mold in order to help spread the plastic in the mold. This approach generally creates a molded object with a solid skin or shell and a void in the center. In FIG. 17, the more solid shell is shown at 142, defining the exterior dimensions of the member 140, and the void is shown at 144. As known to those of skill in the art, the void 144 may not be as symmetrical and well-defined as shown in FIG. 17. Instead, the transition shown between the void 144 and the solid 142 is often irregular and somewhat foamy. A problem with gas-assist injection molding is that it is often difficult to control formation of the shell 142 and void 144. The void 144 will sometimes break through to the surface, thereby creating a part with a poor finish.

Referring now to FIG. 18, a lattice member 146 is shown with a generally bowtie shaped cross-section. That is, the cross-section is thickest at the edge and thinner intermediate the edges. The combination of gas-assist injection molding and the bowtie shaped cross-section provides a benefit. Specifically, the thicker regions adjacent the edges help to "guide" the flow of plastic and gas so that more well defined voids 148 and 150 form in the thicker regions. This potentially saves additional plastic and helps lead to a well-formed part without the voids breaking through to the surface. Once again, the transition from the voids 148 and 150 to the solid regions may not be as well defined as illustrated, but instead may pass through a foamy region and may be less symmetrical. This approach is preferred for formation of the lattice of FIGS. 14–16.

The lattice as shown in FIGS. 14–16 may be of different widths and the spacing between adjacent members in each of the pluralities may be varied for various effects. In one preferred embodiment, each of the lattice members 104 and 102 have a width of approximately 1.5 inches and a spacing between adjacent members of approximately 2.75 inches. Alternatively, members with a width of approximately 1 inch and a spacing of approximately 1 inch may be used. As yet an additional alternative, lattice members may run in pairs with larger spaces between adjacent pairs, as shown in Applicant's issued patent No. D423,687. Other configurations may be made as well. In the illustrated embodiments, the members in the first plurality and the members of the second plurality intersect at approximately 90° angles. However, other angles are also possible.

As will be clear to one of skill in the art, other variations may be made upon the described and illustrated preferred embodiments without departing from the scope or intent of the present invention. Therefore, the preceding description and figures should be interpreted broadly. It is the following claims, including all equivalents, that define the scope of the present invention.

I claim:

1. A one piece molded plastic body simulative of a lattice of separate superposed members, the body comprising:

a first plurality of elongated members lying in a first plane, each of the members having a concave upper surface, a concave lower surface, and a pair of edges interconnecting the upper and lower surfaces, the upper and lower surfaces each having central regions intermediate the edges, the central regions of the upper and lower surfaces beings separated by a distance less than the thickness of the edges such that each of the members have a bow tie shaped cross section; and a second plurality of elongated members lying in a second plane, the second plurality of elongated members intersecting and interconnecting the first plurality of members at a plurality of junction regions, each of the members in the second plurality having a concave upper surface, a concave lower surface, and a pair of edges interconnecting the upper and lower surfaces, the upper and lower surfaces each having central regions intermediate the edges, the central regions of the upper and lower surfaces beings separated by a distance less than the thickness of the edges such that each of the members have a bow tie shaped cross section;

wherein the central region of the lower surface of each of the members in the first plurality is generally coplanar with the central region of the upper surface of each of the members in the second plurality.

2. The one piece molded plastic body according to claim 1, wherein the second plurality of members intersects the first plurality at approximately 90 degrees.

3. The one piece molded plastic body according to claim 1, wherein the upper surface of each of the members slopes upwardly from the central region to the edges at an angle of approximately 3 degrees.

4. The one piece molded plastic body according to claim 1, wherein the upper surfaces of the members in both the first and second plurality have a wood grain disposed thereon.

5. A one piece molded plastic body simulative of an lattice of separate superposed members, the body comprising:

a first plurality of elongated members lying in a first plane, each of the members having a concave upper surface, a concave lower surface, and a pair of edges interconnecting the upper and lower surfaces, the upper and lower surfaces each having central regions intermediate the edges, the central regions of the upper and lower surfaces beings separated by a distance D1 which is less than the thickness of the edges, such that each of the members have a bow-tie shaped cross section; and a second plurality of elongated members lying in a second plane, the second plurality of elongated members intersecting and interconnecting the first plurality of members at a plurality of junction regions, each of the members in the second plurality having a concave upper surface, a concave lower surface, and a pair of edges interconnecting the upper and lower surfaces, the upper and lower surfaces each having central regions intermediate the edges, the central regions of the upper and lower surfaces beings separated by a distance D2 which is less than the thickness of the edges, such that each of the members have a bow-tie shaped cross section;

wherein the central region of the upper surface of each of the members in the first plurality is separated from the central region of the lower surface of each of the members in the second plurality by a distance equal to or less than D1+D2 at each of the junction regions.

6. The one piece molded plastic body according to claim 5, wherein the second plurality of members intersects the first plurality at approximately 90 degrees.

7. The one piece molded plastic body according to claim 5, wherein the upper surface of each of the members slopes upwardly from the central region to the edges at an angle of approximately 3 degrees.

8. The one piece molded plastic body according to claim 5, wherein the upper surfaces of the members in both the first and second plurality have a wood grain disposed thereon.

9. A lattice body comprising:

a first plurality of elongated members lying in a first plane, each of the members having a concave upper surface, a concave lower surface, and a pair of edges interconnecting the upper and lower surfaces, the upper and lower surfaces each having central regions intermediate the edges, the central regions of the upper and lower surfaces beings separated by a distance less than the thickness of the edges such that each of the members have a bow tie shaped cross section; and a second plurality of elongated members lying in a second plane, the second plurality of elongated members intersecting the first plurality of members at a plurality of junction regions, each of the members in the second plurality having a concave upper surface, a concave lower surface, and a pair of edges interconnecting the upper and lower surfaces, the upper and lower surfaces each having central regions intermediate the edges, the central regions of the upper and lower surfaces beings separated by a distance less than the thickness of the edges such that each of the members have a bow tie shaped cross section.

10. The one piece molded plastic body according to claim 9, wherein the second plurality of members intersects the first plurality at approximately 90 degrees.

11. The one piece molded plastic body according to claim 9, wherein the upper surface of each of the members slopes upwardly from the central region to the side regions at an angle of approximately 3 degrees.

12. The one piece molded plastic body according to claim 9, wherein the upper surfaces of the members in both the first and second plurality have a wood grain disposed thereon.

13. The molded plastic lattice according to claim 9, wherein the members in the first and second plurality comprise a molded one piece body.

14. A plastic lattice comprising:

a plurality of elongated members forming the lattice, each of the members having an upper surface, a lower surface, and a pair of edges interconnecting the upper and lower surfaces, the upper and lower surfaces of each of the elongated members being transversely concave so as to give the members a bow-tie shaped cross section.

15. The plastic lattice according to claim 14, wherein the elongated members comprise a first plurality of members lying in a first plane and a second plurality of members lying in a second plane, the second plurality of members intersecting and interconnecting the first plurality of members.

16. The plastic lattice according to claim 14, wherein the lattice comprises a molded one piece body.

* * * * *

UNITED STATES PATENT AND TRADEMARK OFFICE

CERTIFICATE OF CORRECTION

PATENT NO. : 6,470,643 B1
DATED : October 29, 2002
INVENTOR(S) : Richard W. Cantley It is certified that error appears in the above-identified patent and that said Letters Patent is hereby corrected as shown below:

Title page,
Item [63], Related U.S. Application Data, after "Jun. 23, 1999," insert -- which claims the benefit of --.

Column 1,
Line 4, replace "continuation in part" with -- continuation-in-part --.
Line 61, replace "lattice the cost" with -- ;attice. The cost --.

Column 3,
Line 28, replace "13-13." with -- 13-13; --.

Column 6,
Line 16, replace "running" with -- running in one --.

Column 7,
Line 4, replace "member" with -- members --.

Column 8,
Lines 53 and 65, replace "beings" with -- being --.

Column 9,
Line 15, replace "an lattice" with -- a lattice --.
Lines 23 and 35, replace "beings" with -- being --.

Column 10,
Lines 9 and 20, replace "beings" with -- being --.

Signed and Sealed this

Twentieth Day of May, 2003

JAMES E. ROGAN
*Director of the United States Patent and Trademark Office*